US006821210B2

(12) United States Patent
Kallage, Jr.

(10) Patent No.: US 6,821,210 B2
(45) Date of Patent: Nov. 23, 2004

(54) GOLF AIMING AND ALIGNMENT TRAINING MAT

(76) Inventor: Richard G. Kallage, Jr., 4485 Shorewood Ct., Hoffman Estates, IL (US) 60195

( * ) Notice: Subject to any disclaimer, the term of this patent is extended or adjusted under 35 U.S.C. 154(b) by 0 days.

(21) Appl. No.: 10/393,321

(22) Filed: Mar. 20, 2003

(65) Prior Publication Data

US 2004/0185954 A1 Sep. 23, 2004

(51) Int. Cl.[7] ..... A63B 69/36
(52) U.S. Cl. ..... 473/218; 473/278
(58) Field of Search ..... 473/218, 266, 473/270, 278, 279, 155, 225, 271, 272, 273

(56) References Cited

U.S. PATENT DOCUMENTS

| | | | | |
|---|---|---|---|---|
| 1,484,390 A | | 2/1924 | Gibbs et al. | |
| 1,637,339 A | | 8/1927 | Glennon et al. | |
| 3,194,565 A | | 7/1965 | Schroer | |
| 3,350,101 A | | 10/1967 | Bishop et al. | |
| 3,363,903 A | | 1/1968 | O'Brien | |
| 3,510,135 A | | 5/1970 | Gentile | |
| 3,542,369 A | | 11/1970 | Anderson | |
| 3,868,109 A | | 2/1975 | Fowler | |
| 3,992,013 A | | 11/1976 | Golden | |
| 4,000,905 A | | 1/1977 | Shirhall | |
| 4,101,130 A | * | 7/1978 | Richards | 473/270 |
| 4,164,352 A | | 8/1979 | O'Brien | |
| 4,248,431 A | | 2/1981 | Burnes | |
| 4,355,810 A | | 10/1982 | Rydeck | |
| 4,545,581 A | | 10/1985 | Williamson | |
| 4,805,913 A | | 2/1989 | Bott | |
| 4,915,387 A | | 4/1990 | Baxstrom | |
| 5,035,433 A | | 7/1991 | Durso | |
| 5,131,659 A | | 7/1992 | Lindberg, Jr. | |
| 5,163,686 A | | 11/1992 | Bergman | |
| 5,171,017 A | | 12/1992 | Betancourt | |
| 5,333,875 A | | 8/1994 | Wilson | |
| 5,417,428 A | * | 5/1995 | Warren | 473/218 |
| 5,645,494 A | | 7/1997 | Dionne et al. | |
| 6,050,902 A | | 4/2000 | McCrink, Jr. | |
| 6,077,169 A | | 6/2000 | Florian | |
| 6,142,883 A | | 11/2000 | Ferrara | |
| 6,387,013 B1 | * | 5/2002 | Marquez | 482/23 |

* cited by examiner

*Primary Examiner*—Gregory Vidovich
*Assistant Examiner*—Nini F. Legesse
(74) *Attorney, Agent, or Firm*—Christopher J. Scott; Charles F. Meroni, Jr.; Meroni & Meroni, P.C.

(57) ABSTRACT

The present invention provides an L-shaped golf training mat for improving a golfer's aiming and alignment skills. The mat comprises positioning-aiming markings, which markings are longitudinally and latitudinally aligned on the superior mat surface for enabling the golfer to visualize an effective ball-placement-zone distally removed from the L-shaped mat and defined by distally extending and laterally extending zone lines collinear with the positioning-aiming markings. Further, the present invention provides an auxiliary alignment blade removably attachable to the mat for enabling the golfer to align and aim golf shots for variably controlled golf ball flight trajectories. The blade comprises reference markings which function in cooperative association with positioning-aiming markings on the superior mat surface for enabling a golfer to align and aim for variably controlled golf ball flight trajectories.

34 Claims, 5 Drawing Sheets

GOLF AIMING AND ALIGNMENT TRAINING MAT

BACKGROUND OF THE INVENTION

1. Field of the Invention

The present invention generally relates to a golf training aid. More particularly, the present invention relates to a novel and improved golf training mat for use in teaching golfers of all abilities the views and angles of proper golf club aiming and alignment.

2. Description of the Prior Art

Fundamental to a consistent ability to score well in the game of golf is the ability to properly strike a golf ball. By properly striking a golf ball with a given golf club, the golfer may drive the golf ball a given distance along an intended trajectory. In other words, the golfer may thus direct the ball at the intended target with a desired flight path, which flight path may comprise a high path, a low path, a straight path, a fade path or a draw path, as desired. In this regard, the golfer must develop the fundamental ability to visualize the trajectory path or ball-to-target line, square the golf club head perpendicular to the ball-to-target line, appropriately align the golfer's shoulders and feet with respect to the ball-to-target line, and initiate the golf club swing along a line parallel to the plane of the golfer's shoulders.

As many avid golf enthusiasts will attest, the ability to purposefully strike a golf ball in the described proper manner is not a simple undertaking. The golfer must properly aim and align the golf club with the golf ball using proper viewing practices and angles of alignment in order to achieve a proper golf ball strike. Through repetition and/or practice, a skilled golfer typically commits the necessary visualizations and angles of alignment to bodily memory, such that the ability to properly strike a golf ball in a given striking scenario results less from conscious efforts and more from an ingrained golf sense.

The ball-to-target line the golfer visualizes may most conveniently be envisioned by envisioning the plane or line passing through the golfer's shoulders (shoulder line) or the line connecting the tips of the golfer's feet (foot line) as being parallel to the ball-to-target line. The true ball-to-target line is the line whose tail end may be envisioned as emanating approximately three feet away from and roughly parallel to the golfers foot line or shoulder line. Frequently, a golfer will improperly align his or her foot line or shoulder line directly on the target. This improper alignment typically results in a trajectory path or ball-to-target line misaligned or misaimed to the right of the target for right-handed golfers or to the left of the target for left-handed golfers. In order to cure the often-encountered misalignment, the golfer will improperly adjust the golfer's arms or hands during the downswing of a golf club, which typically results in an out-of-control ball flight trajectory. If no arm or hand adjustment is attempted during the downswing, the propelled golf ball will usually fly well right of the intended target for right-handed golfers or well left of the target for left-handed golfers. The described tendency to misalign or misaim is natural and affects golfers of all abilities.

An additional and related golfing flaw is the golfer's inability to square his or her golf club head to the ball-to-target line. In other words, the golfer often fails to strike a golf ball such that the plane of the golf club face is substantially orthogonal to the tail end of the ball-to-tail line. It is often the case that if the ball-to-target line is not well envisioned, it becomes difficult to square the club head. In this regard, when the golf club is drawn back during the backswing, the golfer misaligns the golf club face. In this regard, the golf club face is typically pivoted about its vertical center line in slight degrees. The pivot or rotation about the vertical center line of the golf club face may either be counterclockwise ("toed in" for a right-handed golfer) or clockwise ("toed out" for a left-handed golfer), which slight rotation from the preferred orthogonal positioning, if not corrected during the downswing, results in a trajectory path that is often far left or far right of the intended ball-to-target line, and the head or termination of which is often in a less than ideal location.

While related, the ability to properly align the foot line and/or the shoulder line with the ball-to-target line and the ability to properly square the golf club head require different golfing skills. More particularly, the two noted abilities require different visualization skills and concomitant bodily events. A myriad of golf training aids have been developed in an attempt to aid golfers in their pursuit of perfecting their golfing skills and abilities. It is noted that the prior art teaches a great variety of golf training aids in general and golf training mat-type systems or apparatuses in particular. Some of the more pertinent prior art relating to golf training aids and the like is described hereinafter.

U.S. Pat. No. 1,637,339 ('339 Patent), which issued to Glennon et al. for example, discloses a Means for Instructing Golf Strokes. The '339 Patent teaches a device for the instruction of golf strokes, which comprises a base member, and a pair of laterally spaced longitudinally extending upstanding guide shoulders on said base member. The paired guide members are adapted to define a guide way for the free passage of the head of a properly swung golf-club. A golf ball may be placed intermediate the paired guide members atop the base member and thus may be addressed by a properly swung golf club.

U.S. Pat. No. 3,350,101 ('101 Patent), which issued to Bishop et al., discloses a Golf Swing Aid. The '101 Patent teaches a golf swing practice device comprising a pad having a tee area and a simulated captive ball member therein. Also disclosed is a curved line representing the ground trace of the swing of the club extending to the tee area and a resilient upright member wound on a reel for vertical adjustment located along said line and representing a vertical point on the swing path of said club.

U.S. Pat. No. 3,510,135 ('135 Patent), which issued to Gentile, discloses a Training Device for Golfers. The '135 Patent teaches the combination of a vertically adjustable guide stand that consists of a base to which is secured a vertically adjustable tubular member, called a swing arm holder, to the upper end of which is adjustably secured a horizontally disposed padded swing arm having an outer end against which the golfer places the back of his head; a mat on which the golfer stands and which indicates the position the golfer places his feet when swinging his club to hit the golf ball; and a hitting mat, a rectangular mat having a plurality of equally spaced and parallel guide lines thereon in both the longitudinal and lateral direction. The guide lines are intended to provide means for enabling the golfer to more properly guide the golf club head during the downswing of the golf club.

U.S. Pat. No. 3,542,369 ('369 Patent), which issued to Anderson, discloses a Golf Practice Mat. The '369 Patent teaches a portable practice mat made of felted fibers laterally bordered by plastic material. A tee with a wide base extends upward through a centrally located hole in the mat. Indicia on the plastic material show the direction of the target and the path that the head of the club should follow to drive a ball from the tee to said target. Additional indicia show the proper position of the golfer's feet.

U.S. Pat. No. 3,868,109 ('109 Patent), which issued to Fowler, discloses a Golfer's Practice Mat. The '109 Patent teaches a practice mat for golfers upon which either a left handed or right handed golfer may stand while practice-swinging a golf club and which provides for each a longitudinally extending stance guide slot correlated to a transverse guide slot which cooperate to properly position the feet of the golfer in relation to the ball. An additional transverse guide slot represents the flight line of a ball when the club head is swung parallel to a fourth guide slot defining the swing line of the club head. Colored cleats set in the fourth guide slot Lo psychologically compel the golfer to assume a proper stance on the practice mat and to consistently swing the golf club through a prescribed path over the mat so as to cause the stance and swing to become habitual with the golfer.

U.S. Pat. No. 4,000,905 ('905 Patent), which issued to Shirhall, discloses a Practice Mat for Golfers. The '905 Patent teaches a mat for guiding golfers in addressing the ball on which are indicated positions and angles for the feet, placement of the ball and guide lines to indicate the proper direction to be traversed by the club.

U.S. Pat. No. 4,248,431 ('431 Patent), which issued to Burnes, discloses a Golfing Aid. The '431 Patent teaches a golfing aid comprising a base mat having a target line aligned with an intended course of travel for a golf ball and an approach line obliquely angularly related to the target line and intersecting it adjacent to a predetermined tee position of the ball. Further, an approach mat is slidably rested on the base mat for movement along the approach line and provided with indicia for indicating dispositions of the feet assumed in approaching the ball. A pair of foot mats slidably rest on the approach mat defining a disposition of the feet for addressing the ball and certain devices releasably secure the foot mats in selected relative positions.

U.S. Pat. No. 4,545,581 ('581 Patent), which issued to Williamson, discloses a Golf Practice Aid. The '581 Patent teaches a visual golf practice aid for improving hand-eye coordination by the person actually being able to see the correct way to swing. This is accomplished through a plurality of parallel diagonal lines on a generally square base with a grid of large and small dots to indicate any undesirable sway movement from the fixed fulcrum point.

U.S. Pat. No. 4,805,913 ('913 Patent), which issued to Bott, discloses a Device for Developing Golf Ball Address Stance. The '913 Patent teaches an L-shaped golf teaching, training and practice device comprising in combination a mat, at least one removably attachable or adhesive foot silhouette which is attachable to said mat for the alignment of at least one of a golfer's feet, a precision stance placement grid on said mat comprising vertical and horizontal perception lines, and a swing path on said mat. The device, when used in conjunction with proper exercising will program the subconscious member to achieve a proper and reproducible address and stance for a precision swing.

U.S. Pat. No. 4,915,387 ('387 Patent), which issued to Baxstrom, discloses a Golf Practice and Training Device. The '387 Patent teaches a golf practice mat having an upper surface provided with fixed lines to establish foot and shoulder alignment, swing path guidelines, ball position and unlofting lines in further combination with ball placement markers. Foot position indicia are color-coded to match up with ball placement markers and line of flight arrows to promote proper address and body position with respect to the ball thereby aiding a golfer's shot-making ability.

U.S. Pat. No. 5,131,659 ('659 Patent), which issued to Lindberg, Jr., discloses a Golf Putting Training and Practice Aid. The '659 Patent teaches a golf putting training and practice aid for use by right or left handed golfers to improve their putting stance and stroke comprising a reflective sheet adapted for placement on the ground and provided with indicia to indicate eye position, shoulder position, putter position and travel relative to the reflection of a golfer standing over the device. The indicia comprise a target line along the longitudinal center of the sheet, a center line perpendicular to and bisecting the target line, a pre-impact correction and length gauge along the target line to one side of the center line, a pair of putter head guide lines parallel to and on either side of the target line and shoulder guide lines between the putter head guide lines and the parallel edges of the sheet.

U.S. Pat. No. 5,163,686 ('686 Patent), which issued to Bergman, discloses a Practice Mat for Golfers. The '686 Patent teaches a practice mat for golfers usable in combination with at least one golfball and at least one golf club, for indicating the suggested placement of the golf ball, the suggested alignment of the golf club with the golf ball and the feet of the golfer, and the suggested direction of travel of the head of the golf club. The mat has indicia on a surface. There are indicia including a plurality of rectangles indicating placement of a golf ball and there is a line indicating the desired direction of travel of the golf ball once the golf ball is struck by the preselected club.

U.S. Pat. No. 5,333,875 ('875 Patent), which issued to Wilson, discloses an Alignment System for Golf Ball Driving and Hitting Mat. The '875 Patent teaches an alignment system for aiding in the alignment of a golf club with a golf ball prior to hitting the golf ball comprising a pad of material having a bottom surface for placement on a support surface, and a resilient top surface on which the golf ball is to be placed for hitting. Also included are first and second stripes defined in the top surface of the pad in a side-by-side, generally parallel relationship at or near the location at which the golf ball is to be placed, for enabling the visual alignment of the golf club head relative to the stripes and the golf ball.

From a review of these patents and other prior art generally known in the relevant art, it will be seen that the prior art does not teach an L-shaped golf training mat for enabling the golfer to improve upon the golfer's aiming and alignment skills wherein the L-shaped golf training mat is defined by comprising a substantially planar superior mat surface upon which are placed uniquely configured positioning-aiming markings. In this regard, the prior art does not teach positioning-aiming markings positioned on the superior mat surface of an L-shaped mat, which markings are longitudinally and latitudinally aligned for enabling the golfer to visualize an effective ball-placement-zone distally removed from the L-shaped mat and defined by distally extending and laterally extending zone lines collinear with the positioning-aiming markings. Further, the prior art does not teach the use of positioning-aiming lines to enable the user to visualize a preferred golf-ball-position locator, which golf-ball-position locator is the geometric center of the ball-placement zone and is defined by a distally-laterally removed orthogonal intersection of lines collinear with select position-aiming markings.

It will thus be seen that the prior art does not teach an L-shaped golf training mat comprising positioning-aiming markings which enable a golfer to effectively visualize a golf ball position locator distally and laterally removed from portions of the L-shaped mat, which golf ball position locator functions in cooperative association with the positioning-aiming markings to enable the golfer to align and aim golf shots for more readily controllable golf ball flight trajectories.

Further, the prior art does not teach an upendable mat for selective use either by a right-handed golfer or a left-handed golfer. In this regard, the prior art does not teach a golf training mat comprising markings on the superior mat surface and markings on the inferior mat surface, which markings are mirror images of one another and are configured such that a right-handed golfer may upend or flip over the golf training mat from a right-handed configuration and expose the golf training mat's right-handed inferior mat surface to a left-handed superior mat surface for use by a left-handed golfer.

It will be further seen that the prior art does not teach an auxiliary alignment blade removably attachable to an L-shaped golf training mat for enabling a golfer to align and aim golf shots for variably controlled golf ball flight trajectories. In this regard, it will be seen that the prior art does not teach an L-shaped training mat and blade combination, wherein the superior blade surface comprises reference markings which function in cooperative association with positioning-aiming markings on the superior mat surface for enabling a golfer to align and aim for variably controlled golf ball flight trajectories.

Of the many golf training or practice aids that have been developed, many provide a mat for placement at the golfer's feet, which mat serves to guide the golfer during a golf shot. In this regard, it is noted that many golf training mats comprise markings, which aid the golfer in aligning and aiming his or her golf shot as well as a host of other elemental golf training or practice steps. Indeed, it has been shown that golf training apparatuses in general and golf training mats in particular, are well known in the prior art. However, in addition to often being exorbitantly priced, the golf training mats that have been developed are often cumbersome to practice, cumbersome to stow, cumbersome to transport, and are often severely lacking in substantive educational value. The prior art thus perceives a need for a golf training mat designed to teach the proper aiming and feet/shoulder/golf club alignment methods by teaching and reinforcing the correct views and angles. Further, the prior art perceives a need for a golf training mat, unique in its combination of sound educational utility, and unique in its ease of use, including stowability and portability. Further, the prior art perceives a need for a low cost golf training mat comprising attractive retail commercial features.

The prior art thus perceives a need for an L-shaped golf training mat for enabling a golfer to improve upon the golfer's aiming and alignment skills wherein the L-shaped golf training mat is defined by comprising a substantially planar superior mat surface comprising uniquely configured positioning-aiming markings. In this regard, the prior art perceives a need for positioning-aiming markings positioned on the superior mat surface of an L-shaped mat, which markings are longitudinally and latitudinally aligned for enabling the golfer to visualize an effective ball-placement-zone distally removed from the L-shaped mat and defined by distally extending and laterally extending zone lines collinear with the positioning-aiming markings. Further, the prior art perceives a need for positioning-aiming lines, which enable the golfer to visualize a preferred golf-ball-position locator, which golf-ball-position locator is the geometric center of the ball-placement zone and is defined by a distally-laterally removed orthogonal intersection of lines collinear with select position-aiming markings.

Further, the prior art perceives a need for an L-shaped golf training mat comprising a golf ball position locator distally and laterally removed from portions of the L-shaped mat, which golf ball position locator functions in cooperative association with the positioning-aiming markings to enable the golfer to align and aim golf shots for more readily controllable golf ball flight trajectories. Further, the prior art perceives a need for an upendable mat for selective use either by a right-handed golfer or a left-handed golfer. In this regard, the prior art perceives a need for a golf training mat comprising markings on the superior mat surface and markings on the inferior mat surface, which markings are mirror images of one another and are configured such that a right-handed golfer may upend or flip over the golf training mat from a right-handed configuration and expose the golf training mat's right-handed inferior mat surface to a left-handed superior mat surface for use by a left-handed golfer.

Further, the prior art perceives a need for an auxiliary alignment blade removably attachable to an L-shaped golf training mat for enabling the golfer to align and aim golf shots for variably controlled golf ball flight trajectories. In this regard, the prior art perceives a need for an L-shaped training mat and auxiliary alignment blade combination, wherein the superior blade surface comprises reference markings which function in cooperative association with positioning-aiming markings on the superior mat surface for enabling a golfer to align and aim for variably controlled golf ball flight trajectories.

SUMMARY OF THE INVENTION

Accordingly, it is an object of the present invention to provide a golf training mat that teaches the golfing user the proper aiming and feet/shoulder/golf club alignment methods by teaching and reinforcing the correct views and angles. Further, it is an object of the present invention to provide a golf training mat, unique in its combination of educational utility and soundness. It is a further object of the present invention to provide a golf training mat which is easy of use, easy to stow and easy to transport. Further, it is an object of the present invention to provide a golf training mat low in cost and provides attractive retail commercial features.

More particularly, it is an object of the present invention to provide an L-shaped golf training mat for enabling a golfer to improve upon the golfer's aiming and alignment skills wherein the L-shaped golf training mat is defined by comprising a substantially planar superior mat surface, which comprises uniquely configured positioning-aiming markings. In this regard, it is an object of the present invention to provide positioning-aiming markings uniquely positioned on the superior mat surface of an L-shaped mat, which markings are longitudinally and latitudinally aligned in particular spatial locations for enabling the golfer to visualize an effective ball-placement-zone distally removed from the L-shaped mat relative to the golfer and defined by distally extending and laterally extending zone lines collinear with the positioning-aiming markings. Further, it is an object of the present invention to provide positioning-aiming lines atop an L-shaped golf training mat, which enable the golfer to visualize a preferred golf-ball-position locator, which golf-ball-position locator is the geometric center of the ball-placement zone defined by a distally-laterally removed orthogonal intersection of lines collinear with select position-aiming markings. Thus, it is a primary object of the present invention to provide an L-shaped golf training mat comprising positioning-aiming markings, which enable a golfer to effectively visualize a golf ball position locator distally and laterally removed from portions of the L-shaped mat, which golf ball position locator functions in cooperative association with the positioning-aiming markings to enable the golfer to align and aim golf shots for more readily controllable golf ball flight trajectories.

Further, it is an object of the present invention to provide an upendable mat for selective use either by a right-handed golfer or a left-handed golfer. In this regard, it is an object of the present invention to provide a golf training mat comprising markings on the superior mat surface and markings on the inferior mat surface, which markings are mirror images of one another and are configured such that a right-handed golfer may upend or flip over the golf training mat from a right-handed configuration and expose the golf training mat's right-handed inferior mat surface to a left-handed superior mat surface for use by a left-handed golfer.

Still further, it is an object of the present invention to provide an auxiliary alignment blade removably attachable to the L-shaped golf training mat for enabling a golfer to align and aim golf shots for variably controlled golf ball flight trajectories. In this regard, it is an object of the present invention to provide an L-shaped training mat and auxiliary alignment blade combination, wherein the superior blade surface of the auxiliart alignment blade comprises reference markings which function in cooperative association with positioning-aiming markings on the superior mat surface to enable a golfer to align and aim for variably controlled golf ball flight trajectories.

To achieve these and other readily apparent objectives, the present invention provides a golf training mat for enabling a golfer to improve upon the golfer's aiming and alignment skills, the golf training mat comprising a substantially planar, L-shaped mat. The L-shaped mat comprises a superior mat surface, an inferior mat surface, a longitudinal axis, and a latitudinal axis. The superior mat surface comprises main mat coloration for providing a visualization template; the inferior mat surface is designed to compliantly engage an underlying substrate surface; and the longitudinal axis intersects with the latitudinal axis at the one exterior corner location of the L-shaped mat. In this last regard, it is noted that an L-shaped mat will necessarily comprise at least six peripheral edges, five interior corners, and one exterior corner. The six peripheral edges comprise three latitudinal edges and three longitudinal edges wherein the latitudinal edges are further defined by comprising a distal mat edge distally parallel to the latitudinal axis, a reference-positioning edge coaxial with the latitudinal axis, and a reference-alignment edge proximally parallel to the latitudinal axis. The longitudinal edges are further defined by comprising a fore mat edge laterally spaced and parallel to the longitudinal axis, an aiming-squaring edge coaxial with the longitudinal axis, and a rear mat edge laterally spaced and parallel to the longitudinal axis.

The superior mat surface further comprises positioning-aiming markings, which may be defined by comprising longitudinal positioning lines and latitudinal aiming lines. The positioning lines comprise a main-ball-positioning pattern and a takeaway-ball-positioning line. The main-ball-positioning pattern comprises a main-ball-positioning line, paired distal-auxiliary-positioning lines, and paired proximal-auxiliary-positioning lines. The main-ball-positioning line orthogonally intersects both the reference-positioning edge and the reference-alignment edge. The distal-auxiliary-positioning lines orthogonally intersect the reference-positioning edge laterally opposite and equidistant from the main-ball-positioning line and the proximal-auxiliary-positioning lines orthogonally intersect the reference-alignment edge laterally opposite and equidistant from the main ball positioning line. The distal-auxiliary-positioning lines are collinear with the proximal-auxiliary-positioning lines. The takeaway-ball-positioning line orthogonally intersects the reference-positioning edge and the reference alignment edge medial to the main ball positioning pattern. The main-ball-positioning line thus enables the golfer to visualize a visual-positioning-line extending distally from the reference-positioning edge collinear with the main-ball-positioning line.

The aiming lines comprise a fore-main-aiming line, a rear-main-aiming line, paired fore-auxiliary-aiming lines, and paired rear auxiliary aiming lines. The fore-main-aiming line orthogonally intersects the aiming-squaring edge; the fore-auxiliary-aiming lines orthogonally intersect the aiming-squaring edge longitudinally opposite and equidistant from the fore-main-aiming line; the rear-main-aiming line orthogonally intersects the rear mat edge; and the rear-auxiliary-aiming lines orthogonally intersect the rear mat edge longitudinally opposite and equidistant from the rear-main-aiming line. The fore-auxiliary-aiming lines are collinear with the rear-auxiliary-aiming lines and the fore-main-aiming line is collinear with the rear-main-aiming line thus forming a collinear main-aiming-line-pairing. The main-aiming-line pairing is designed to enable a golfer to visualize a visual-aiming line extending laterally from the aiming-squaring edge collinear with the main-aiming-line-pairing.

Together, the main-ball-positioning pattern and the aiming lines thus enable a golfer to visualize an effective ball-placement-zone distally removed from the L-shaped mat relative to the golfer and defined by distally extending and laterally extending zone lines collinear with the main-ball-positioning pattern and the aiming lines. The ball-placement-zone further comprises a preferred golf-ball-position locator, the golf-ball-position locator being defined by an orthogonal intersection of the visual-positioning line and the visual-aiming line at the geometric center of the ball-placement zone. The positioning-aiming markings thus enable a golfer to align and aim for controlled golf ball flight trajectories as will be described in more detail in the section below entitled, Detailed Description of the Preferred Embodiment.

Additionally, the present invention provides a combination golf training mat and auxiliary alignment blade apparatus. The auxiliary alignment blade comprises a centered longitudinal blade axis, a superior blade surface, an inferior blade surface, a left blade end, a right blade end, a linear distal blade edge, and a linear proximal blade edge. Further disclosed are pivot fastening means cooperatively associated with the auxiliary alignment blade, which function to removably attach to the auxiliary alignment blade to the L-shaped mat adjacent the reference-alignment edge. The pivot fastening means are cooperatively associated with a user-selected, proximally located internal corner. The removably attached auxiliary alignment blade is pivotable about a blade pivot axis located at the selected internal corner and is designed to enable a golfer to align and aim for variably controlled golf ball flight trajectories described in more detail in the section below entitled, Alternative Embodiment.

Other objects of the present invention, as well as particular features, elements, and advantages thereof, will be elucidated in, or apparent from, the following description and the accompanying drawing figures.

BRIEF DESCRIPTION OF THE DRAWINGS

Other features of my invention will become more evident from a consideration of the following brief description of my patent drawings, as follows:

FIG. 6(*b*) is a proximal end view of the auxiliary alignment blade attachment of FIG. 6(*a*).

DETAILED DESCRIPTION OF THE PREFERRED EMBODIMENT

Figure 1:
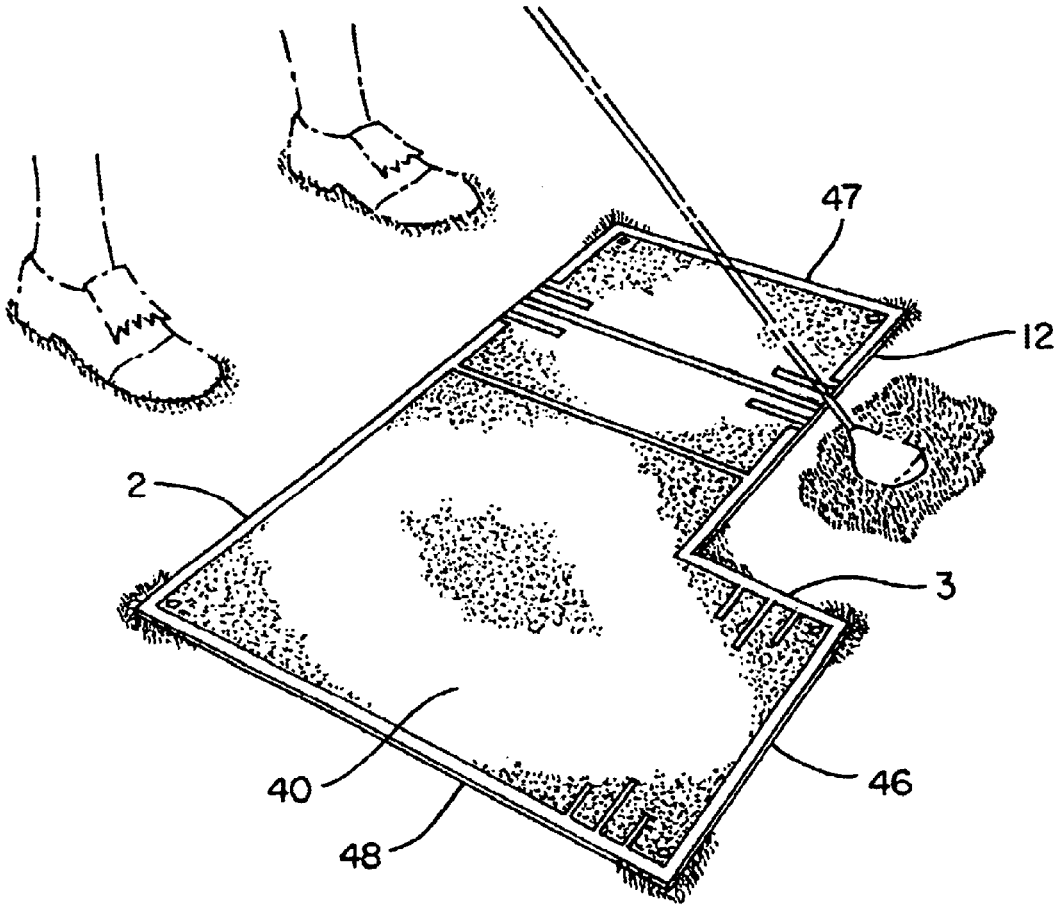
FIG. 1 is a perspective view of the preferred embodiment of the golf training apparatus as positioned for use by a right-handed golfer.

Golf is a game of skill, consistency and control practiced by imparting golf club strokes upon a golf ball. The primary object of golf is to displace the golf ball a certain distance from an initial location (the tee) to a terminal location (the cup) and have the path of the golf ball terminate in the cup by imparting the least number of strokes possible. In this regard, it is noted that physical laws play a key role in the golfer's success or failure. Indeed, physical laws impact every aspect of the game, from the motion of the swing, to the short precise motion of the putt. In short, physical laws must be realized and appreciated to become a successful golfer.

In a typical golf stroke scenario, the golf ball is initially at rest because there are no unbalanced forces on the golf ball. As a golfer strikes the golf ball with a gold club, the net force on the golf ball is nonzero and will cause the golf ball to accelerate in the target direction. The distance that the golf ball travels is directly related to the force applied to it, the angle at which the force is applied, gravitational force, air resistance, and wind resistance. In this last regard, it will be understood that the expert golfer regularly makes use of aerodynamic forces. This may, for example, be appreciated by viewing a well-executed stroke or drive off the tee. Well-driven golf balls typically climb in a nearly straight line for a period of time before they begin to fall. This would indicate that a very nearly zero net force acts on a well-driven golf ball in the vertical direction. Since gravitational force is ever present, the vertically balancing or "lifting" force can be ascribed to the aerodynamic forces imparted on the dimpled spinning golf ball, traveling at a high speed.

Every golfer who has ever hit a golf ball with a golf club realizes that the flight of the golf ball is affected by aerodynamic forces such as those described in previous example. Without the force of the air on the golf ball, the golf ball would travel on a very different path than it actually does. Just as billiards is not played using a protractor to measure angles and a slide rule to make calculations, a golfer is not likely to carry an anemometer, a barometer, surveying instruments, and the necessarily more complicated computing equipment to the golf course. In billiards, the player carefully considers his or her shot, and thereby feeds into the player's brain the necessary visual information to make a reasonable decision on what must be done to succeed in a given shot scenario. Similarly, in golf the golfer must carefully consider his or her shot. Skilled golfers typically consider the slope and condition of the ground where the golfer intends to have the shot land; the strength and direction of the wind; possible hazards; and even the psychological atmosphere of the match. With all of the possible information available, the golfer utilizes judgment and strikes the golf ball. This noted judgment inevitably rests on the golfer's experience with similar shots in the past.

As earlier indicated, the ability to consistently score well in the game of golf is the ability to properly strike a golf ball. By properly striking a golf ball with a given golf club, the golfer may drive the golf ball a given distance along an intended trajectory. In other words, the golfer may thus direct the ball at the intended target with a desired flight path, which flight path may, for example, comprise a high path, a low path, a straight path, a fade path or a draw path, as desired. In this regard, the golfer must develop the fundamental ability to visualize the trajectory path or ball-to-target line, square the golf club head perpendicular to the ball-to-target line, appropriately align the golfer's shoulders and feet with respect to the ball-to-target line, and initiate the golf swing along a line parallel to the plane of the golfer's shoulders.

As many avid golf enthusiasts will attest, the ability to purposefully strike a golf ball in the described proper manner is not a simple undertaking. The golfer must properly aim and align the golf club with the golf ball using proper viewing practices and angles of alignment in order to achieve a proper golf ball strike. Through repetition and/or practice, a skilled golfer typically commits the necessary visualizations and angles of alignment to bodily memory, such that the ability to properly strike a golf ball in a given striking scenario results less from conscious efforts and more from an ingrained golf sense.

The ball-to-target line the golfer visualizes may most conveniently be envisioned by envisioning the plane or line passing through the golfer's shoulders (shoulder line) or the line connecting the tips of the golfer's feet (foot line) as being parallel to the ball-to-target line. The true ball-to-target line is the line whose tail end may be envisioned as emanating approximately 2½–4 feet away from and roughly parallel to the golfers foot line or shoulder line. Frequently, a golfer will improperly align his or her foot line or shoulder line directly on the target. This improper alignment typically results in a trajectory path or ball-to-target line misaligned or misaimed to the right of the target for right-handed golfers or to the left of the target for left-handed golfers. In order to cure the often-encountered misalignment, the golfer will improperly adjust the golfer's arms or hands during the downswing of a golf club, which typically results in an out-of-control ball flight trajectory. If no arm or hand adjustment is attempted during the downswing, the propelled golf ball will usually fly well right of the intended target for right-handed golfers or well left of the target for left-handed golfers. The described tendency to misalign or misaim is natural and affects golfers of all abilities.

An additional and related golfing flaw is the golfer's inability to square his or her golf club head to the ball-to-target line. In other words, the golfer often fails to strike a golf ball such that the plane of the golf club face is substantially orthogonal to the tail end of the ball-to-tail line. It is often the case that if the ball-to-target line is not well envisioned, it becomes difficult to square the club head. In this regard, when the golf club is drawn back during the backswing, the golfer misaligns the golf club face. In this regard, the golf club face is typically pivoted about its vertical center line in slight degrees, generally of the order from about 2–10 rotational degrees. The pivot or rotation about the vertical center line of the golf club face may either be counterclockwise ("toed in" for a right-handed golfer) or clockwise ("toed out" for a left-handed golfer), which slight rotation from the preferred orthogonal positioning, if not corrected during the downswing, results in a trajectory path that is often far left or far right of the intended ball-to-target line, and the head or termination of which is often in a less than ideal location. While related, the ability to properly align the foot line and/or the shoulder line with the ball-to-target line and the ability to properly square the golf club head require different golfing skills. More particularly, the two noted abilities require different visualization skills and concomitant bodily events. The present invention addresses these factors as is discussed hereinafter.

The preferred embodiment of the present invention concerns a golf training apparatus or golf training mat 1 as illustrated in FIGS. 1–5, and 10. Golf training mat 1 is designed to enable a golfer to improve upon the golfer's aiming and alignment skills and in this regard enables a golfer to align and aim for controlled golf ball flight trajectories as will be discussed in more detail below. Golf training mat 1 essentially comprises a substantially planar mat, which mat is preferably constructed in an L-shaped configuration as may be seen from a general inspection of FIGS. 1, and 3–5. The L-shaped mat or golf training mat 1 is preferably constructed from "compliant," "low memory" materials such as elastomer, cloth-elastomer compositions, rubber or other materials which are highly "compliant," of "low memory" and satisfy other conditions such as resistance to environmental conditions such as day-long exposure to rain or sunlight, and week-long excursions having wide range temperature fluctuations, such as may be seen in golf bag storage, car trunk storage or other storage areas which lack temperature controlling means.

For purposes of this disclosure, it should be understood that the term "compliant" is meant to refer to the ability to readily conform to an underlying substrate such as a golf range or golf course fairway. Further, it should be understood that the term "low memory" is meant to refer to the ability to rapidly comply with an underlying substrate when unconstrained from a prior condition, such as when a mat is unrolled or unfurled from a rolled or furled state. It will thus be seen that a mat constructed from elastomer, cloth-elastomer compositions, rubber or other similar materials, which are highly "compliant," and of "low memory," may readily conform to an underlying substrate such as a golf range or golf course fairway and may rapidly comply to a new underlying substrate when unconstrained from a prior condition, such as a rolled or furled state.

Figure 2:
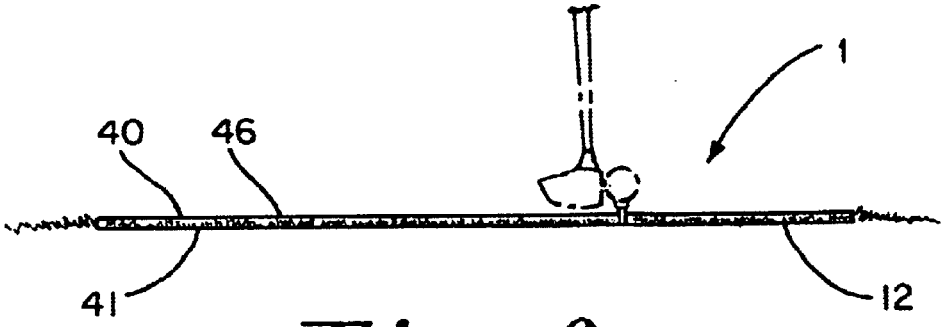
FIG. 2 is a distal end view of the golf training apparatus of FIG. 1.
Figure 3:
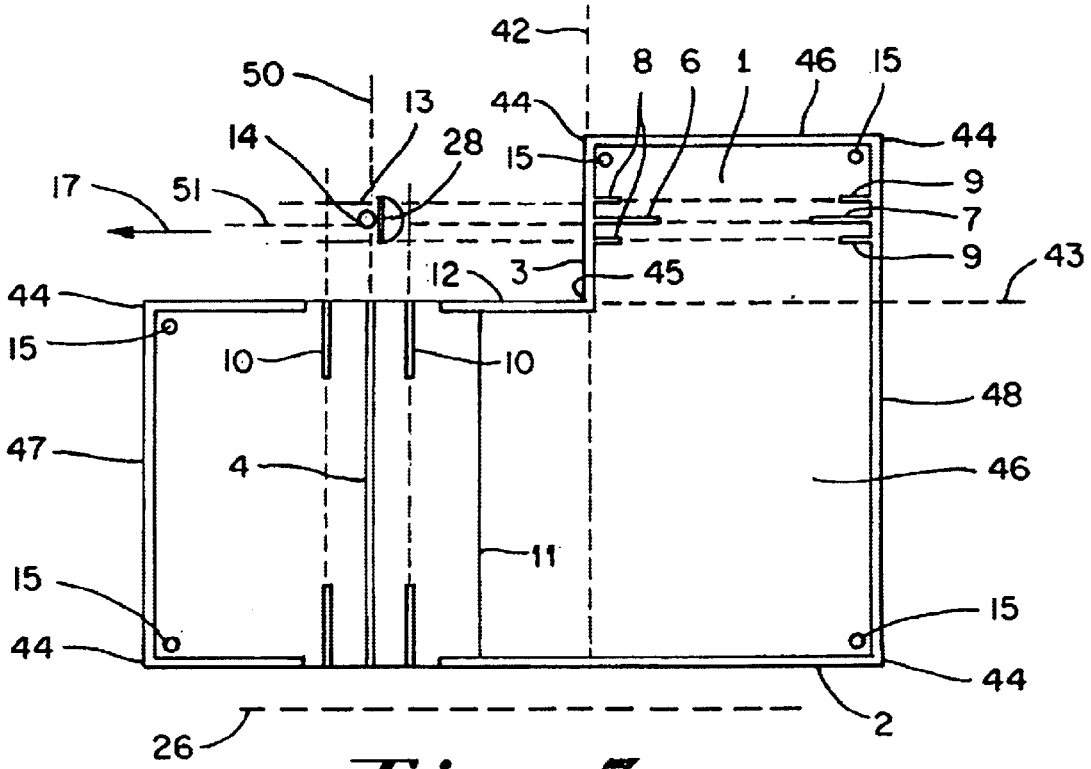
FIG. 3 is a top plan view of the preferred embodiment of the golf training apparatus for use by a right-handed golfer.
Figure 9:
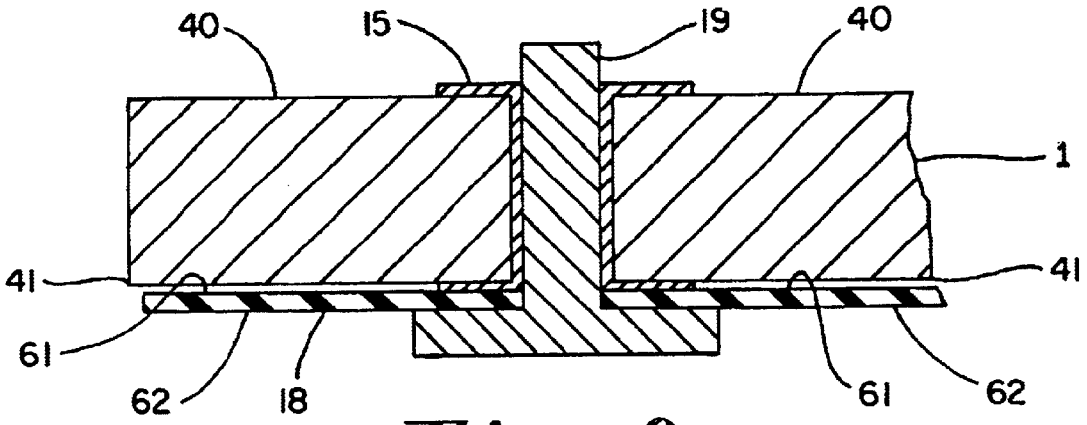
FIG. 9 is a fragmentary cross-sectional side view of the junction of the auxiliary alignment blade removably attached to the mat as referenced in FIG. 5.

Golf training mat 1 preferably comprises a superior mat surface 40 as illustrated in FIGS. 1–5, and 9; an inferior mat surface 41 as illustrated in FIGS. 2 and 9; a longitudinal axis 42 as illustrated in FIG. 3, a latitudinal axis 43 as illustrated in FIG. 3, a plurality of peripheral edges, a plurality of interior corners 44 as illustrated in FIG. 3, and at least one exterior corner 45 as illustrated in FIG. 3. Superior mat surface 40 preferably comprises main mat coloration for providing a sort of visualization template. Preferably, the specified main mat coloration comprises a rather light reflective coloration such as white or lighter shades of various other colors so as to provide a light-colored or highly light reflective backdrop for the visualization template. In this last regard, it should be understood that the visualization template is essentially a backdrop for receiving specifically located markings. It is thus contemplated that superior mat surface 40 preferably comprises main mat coloration as described so as to receive markings comprising relatively darker shades or highly light absorbent coloration. In this regard, it is noted that golf training mat 1 should be constructed from materials capable of receiving decorating means such as paint and the like, which will increase the effectiveness of the present invention. Inferior mat surface 41 is designed to compliantly engage an underlying substrate surface such as a golf range or golf course fairway or other similar substrate, typically found in golf shot scenarios.

As will be seen from a review of FIG. 3, longitudinal axis 42 and latitudinal axis 43 orthogonally intersect at exterior corner 45. Longitudinal axis 42 and latitudinal axis are included in this description for illustration purposes and it should be understood that the referenced axes are not visible per se, but may be envisioned as being coaxial with the subject edges of golf training mat 1 as shown in FIG. 3. Longitudinal axis 42 and latitudinal axis 43 are thus included to provide the reader with a reference frame for the following descriptions.

It will be further understood that any L-shaped mat will necessarily comprise a plurality of peripheral edges and will typically comprise six, substantially linear edges as may be seen from a general review of FIGS. 1, 3–5, and 7. In this regard, it will be further seen that the six peripheral edges comprise three latitudinal or edges and three longitudinal edges. The latitudinal edges of the present invention may be described by preferably comprising a distal mat edge 46 distally parallel to latitudinal axis 43 as illustrated in FIGS. 1–5; a reference-positioning edge 12 coaxial with the latitudinal axis as illustrated in FIGS. 1–5; and a reference-alignment edge 2 proximally parallel to the latitudinal axis as illustrated in FIGS. 1, and 3–5. The longitudinal edges may be described by preferably comprising a fore mat edge 47 laterally spaced and parallel to the longitudinal axis as illustrated in FIGS. 1, and 3–5; an aiming-squaring edge 3 coaxial with the longitudinal axis as illustrated in FIGS. 1, and 3–5; and a rear mat edge 48 laterally spaced and parallel to the longitudinal axis as illustrated in FIG. 1, and 3–5. For right-handed users, it will be seen that fore mat edge 47 is laterally left and rear mat edge 48 is laterally right relative to the user. It should be understood that the spatial orientation of fore mat edge 47 and rear mat edge 48 will necessarily be left-to-right reversed for left-handed users. It will be further seen that reference-positioning edge 12 is parallel to reference-alignment edge 2. This structural feature provides visual consistency of proper alignment.

The preferred length of golf training mat 1 is variable depending on manufacturer and marketing preference, as is the width. It is contemplated that in the preferred commercial embodiment, reference-alignment edge 2 has a measured dimension of about 36 inches and rear mat edge 48 has a measured dimension of about 25 inches. Aiming-squaring edge preferably has a measured dimension of between 8 and 10 inches and reference positioning edge 12 preferably has a measured dimension of 21¾ inches so as to allow for a sufficiently sized ball placement zone or hitting area, described in more detail below. The preferred thickness of golf training mat 1 has a measured dimension between ⅛ inch and 3/16 inch so as to allow sufficient club clearance on the backswing.

Each interior corner 44 preferably comprises a weighting eyelet 15 as illustrated in FIGS. 3–5 and 9. In this regard, it will be seen that golf training mat 1 comprises three distally-located or distal weighting eyelets 15 and two proximally-located or proximal weighting eyelets 15. It is contemplated that weighting eyelets 15 have at least three primary functions. The first of the primary functions is to provide edge weighting to assist in preventing interior corners 44 from curling upward after golf training mat is unrolled. Weighting eyelets 15 thus function to assist inferior surface 41 in complying with the underlying substrate surface. The second of the primary functions enables utilization of the proximally-located weighting eyelets 15 as pivot holes. A further description of this second function will be described in more detail under the section entitled Alternative Embodiment. The third primary function of weighting eyelets 15 is to function as a means for hanging golf training mat 1. For example, golf training mat 1 may either be hung for storage purposes or for commercial marketing displays and the like.

Figure 4:
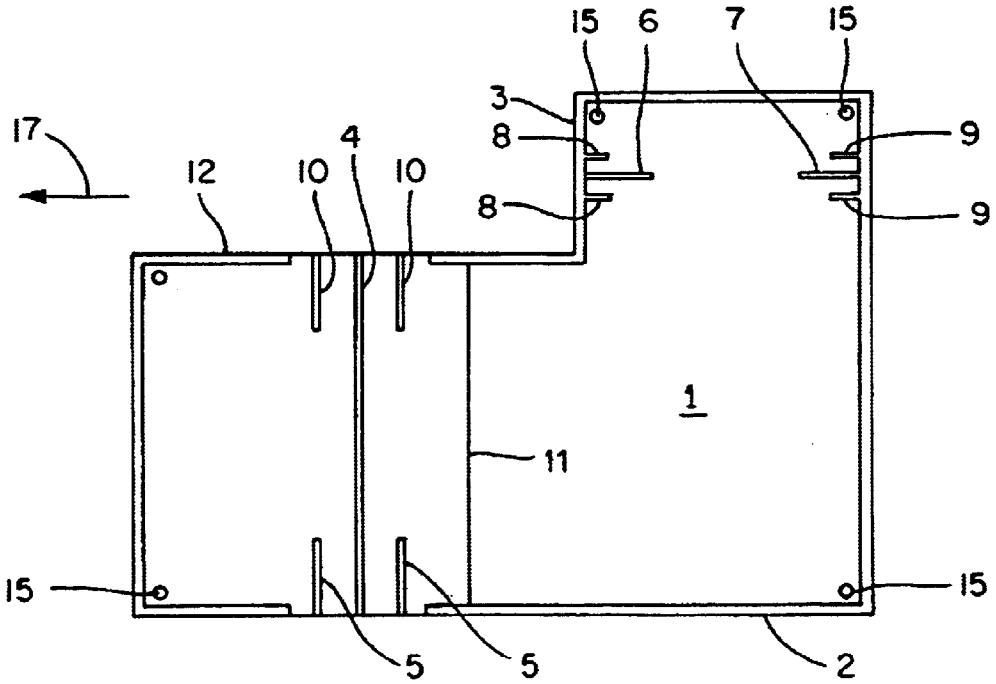
FIG. 4 is an additional top plan view of the preferred embodiment of the golf training apparatus for use by a right-handed golfer.
Figure 5:
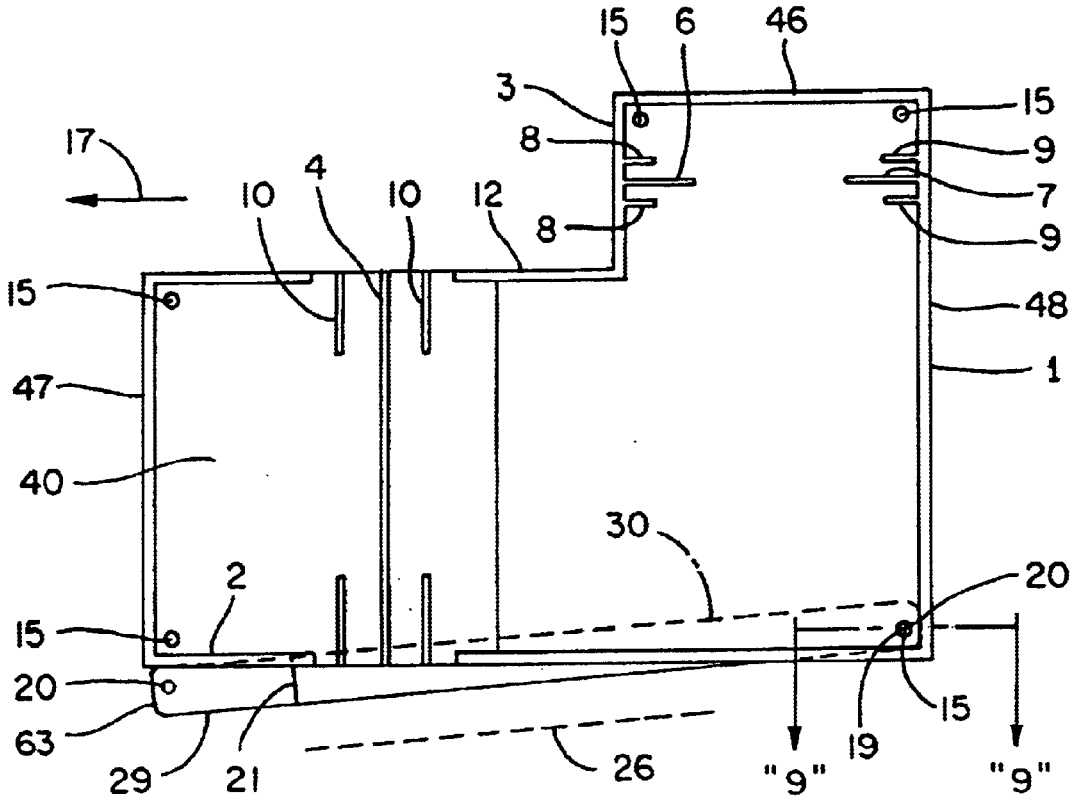
FIG. 5 is a top plan view of an alternative embodiment of the golf training apparatus, showing a mat and auxiliary alignment blade combination for use by a right-handed golfer.

It will be seen that superior mat surface 40 preferably comprises positioning-aiming markings as generally illustrated in FIGS. 1, 3–5. The positioning-aiming markings may be more specifically defined by comprising a series of longitudinal positioning lines and a series of latitudinal aiming lines. The positioning lines preferably comprise a main-ball-positioning pattern and a takeaway-ball-positioning line 11, which takeaway-ball-positioning line 11 is illustrated in FIGS. 3–5. The main-ball-positioning pattern preferably comprises at least one main longitudinal positioning line or main-ball-positioning line 4 as illustrated in FIGS. 3–5; paired distal-auxiliary-positioning lines 10 as illustrated in FIGS. 3–5; and paired proximal auxiliary-positioning lines 5 as illustrated in FIG. 3–5. As will be seen from a review of the subject figures, main-ball-positioning line 4 orthogonally intersects both reference-positioning edge 12 and the reference-alignment edge 2 and thus is intermediate reference-positioning edge 12 and the reference-alignment edge 2. Further, it will be seen that distal-auxiliary-positioning lines 10 orthogonally intersect reference-positioning edge 12 laterally opposite and equidistant from main-ball-positioning line 4. Similarly, proximal-auxiliary-positioning lines 5 orthogonally intersect reference-alignment edge 2 laterally opposite and equidistant from main-ball-positioning line 4. It will be understood that distal-auxiliary-positioning lines 10 are preferably collinear with proximal-auxiliary-positioning lines 5. Takeaway-ball-positioning line 11 orthogonally intersects reference-positioning edge 12 and reference alignment edge 2 medial to the main-ball-positioning pattern. Main-ball-positioning line 4 is designed to enable the golfer to envision or visualize a first locating line or visual-positioning-line 50 extending distally from reference-positioning edge 12 collinear with main-ball-positioning line 4 as illustrated in FIG. 3.

The aiming lines comprise at least one main latitudinal aiming line intermediate aiming-squaring edge 3 and rear mat edge 48. Preferably, however, the aiming lines comprise a fore-main-aiming line 6 as illustrated in FIGS. 3–5; a rear-main-aiming line 7 as illustrated in FIGS. 3–5; paired fore-auxiliary-aiming lines 8 as illustrated in FIGS. 3–5; and paired rear-auxiliary-aiming lines 9 as illustrated in FIGS. 3–5. It will thus be seen that fore-main-aiming line 6 orthogonally intersects aiming-squaring edge 3 and fore-auxiliary-aiming lines 8 orthogonally intersect aiming-squaring edge 3 longitudinally opposite and equidistant from fore-main-aiming line 6. It will be further seen that rear-main-aiming line 7 orthogonally intersects rear mat edge 48 and rear-auxiliary-aiming lines 9 orthogonally intersect rear mat edge 48 longitudinally opposite and equidistant from rear-main-aiming line 7. It will be further understood that fore-auxiliary-aiming lines 8 are preferably collinear with rear-auxiliary-aiming lines 9. It will be further seen that fore-main-aiming line 6 is preferably collinear with rear-main-aiming line 7 thus forming a collinear main-aiming-line-pairing. The noted main-aiming-line pairing or the main latitudinal aiming line is designed to enable the golfer to visualize a second locating line or a visual-aiming line 51 extending laterally from aiming-squaring edge 3 collinear with the main-aiming-line-pairing as illustrated in FIG. 3.

The main-ball-positioning pattern and the aiming lines thus enable the golfer to visualize an effective ball-placement zone 13 as illustrated in FIGS. 1, and 3–5. As will be seen from a review of FIGS. 1, and 3–5 and by a careful consideration of this description, ball-placement zone 13 is effectively defined by zone lines collinear with the main-ball-positioning pattern and the aiming lines. Ball-placement zone 13 thus comprises a preferred golf-ball-position locator 14 as illustrated in FIGS. 3–5. It will be understood that golf-ball-position locator 14 or ball-placement locator is effectively defined by an orthogonal intersection of visual-positioning line 50 and visual-aiming line 51. Golf training mat 1 may thus placed upon the underlying substrate such that golf-ball-position locator 14 is located at the golf ball or may be placed so that the golf ball may be positioned at the golf-ball-position locator. The positioning-aiming markings thus function to enable a golfer to align and aim for controlled golf ball flight trajectories. It should be understood that visual-positioning-line 50, visual-aiming line 51, ball-placement zone 13, and golf ball position locator 14 are not visible per se, but may be envisioned as being defined by their collinear relationship with the described lines of golf training mat 1 as shown in FIG. 3.

Preferably, the positioning-aiming markings comprise contrasting line coloration, which line coloration markedly contrasts with the main mat coloration so as to more visually define the subject positioning-aiming lines and thus enable the user to more readily visualize the zone lines coextensive with the main-ball-positioning pattern and the aiming lines. In this regard, it is contemplated that the line coloration preferably comprises highly light absorbent coloration or relatively darker shades of color to contrast with the highly light reflective or lighter shades of color of the main mat coloration.

Further, in this regard, reference-positioning edge 12, reference-alignment edge 2, and aiming-squaring edge 3 also preferably comprise marked edge coloration, which contrasts with the main mat coloration. It is contemplated that the noted edge coloration also preferably comprises highly light absorbent coloration or relatively darker shades of color to contrast with the highly light reflective or lighter shades of color of the main mat coloration. The edge coloration aids in visually defining the subject edges. It is further contemplated that distal mat edge 46, fore mat edge 47, and rear mat edge 48 also comprise edge coloration as described. However, it is noted that reference-positioning edge 12, reference-alignment edge 2, and aiming-squaring edge 3 are the primary functional edges and thus are preferably provided with contrasting edge coloration so as to increase the effectiveness of golf training mat 1.

Figure 7:
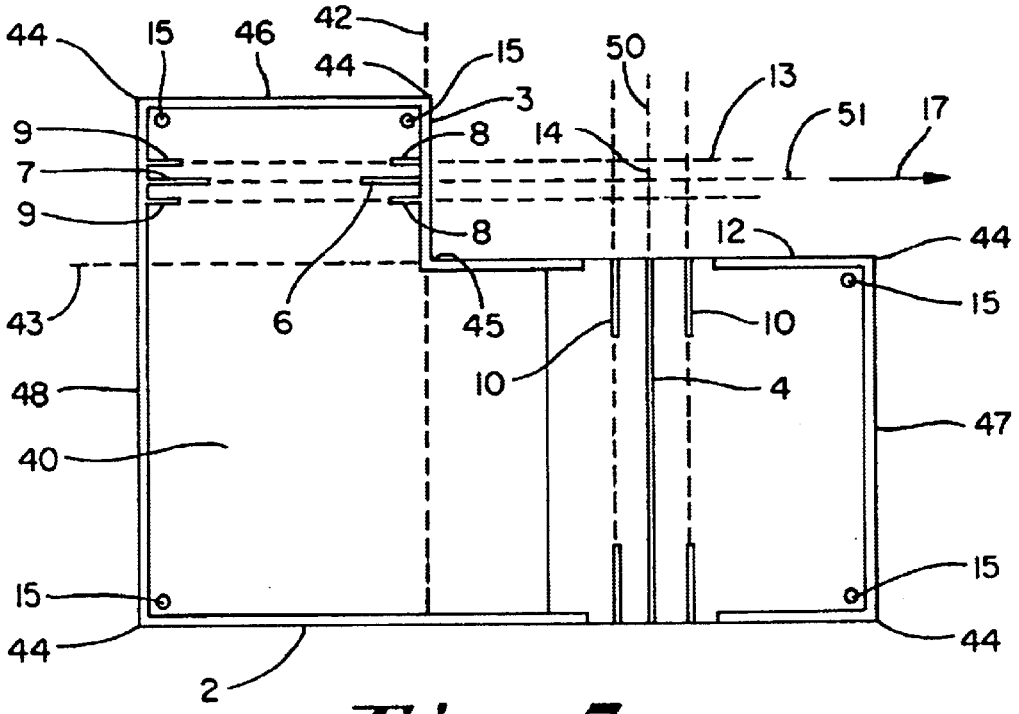
FIG. 7 is a top plan view of the preferred embodiment of the golf training apparatus for use by a left-handed golfer.

Golf training mat 1 as shown in FIGS. 1, and 3–5 illustrate a golf training apparatus for use by a right-handed golfer. As shown in FIG. 7, golf training mat 1 may also be utilized by left-handed golfers provided the structure of the mat is effectively reversed and the applied markings are an effective mirror image of the "right-handed" markings. In this regard, it is contemplated that golf training mat may be an upendable golf training mat in which case inferior mat surface 41 may comprise a mirrored image of superior mat surface 40 so that a right-handed golfer may flip or upend golf training mat 1 so as to place superior mat surface 40 in adjacency to the underlying substrate surface and locate inferior mat surface 41 in an exposed left-handed orientation for use by a left-handed golfer. It is contemplated that golf training mat 1 may be utilized in situations calling for right-handed or left-handed use such as a golf training course or clinic in which right-hand and left-handed golfing students are enrolled. The described feature thus allows golfing instructors to more easily instruct the golfing student regardless of the student's physical proclivities.

It will be seen that FIG. 7 is essentially a mirror image of FIG. 3; in other words, the positioning-aiming markings and structural configuration of golf training mat 1 are left-to-right reversed and thus the reference numerals and attendant descriptions of these features are incorporated herein by reference thereto. Notably, superior mat surface 40 may also be designed so as to compliantly engage an underlying substrate surface such as a golf range or golf course fairway or other similar substrate, typically found in golf shot scenarios. Further, inferior mat surface 41 may also comprise main mat coloration for providing the described visualization template. Again, the main mat coloration is preferably of a rather light reflective coloration such as white or lighter shades of various other colors so as to provide a light-colored or highly light reflective backdrop for the visualization template. In this last regard, it should be understood that the visualization template is essentially a backdrop for receiving specifically located positioning-aiming markings. It is thus contemplated that inferior mat surface 41 may also comprise main mat coloration as described to as receive markings comprising dark-colored or highly light absorbent coloration. In this regard, it is noted that golf training mat 1 should be constructed from materials capable of receiving decorating means such as paint and the like, which will increase the effectiveness of the present invention.

It has been shown in FIG. 1 that golf training mat 1 is set up for use by a right-handed golfer. In this scenario, the golfer's left foot is closest to and in the direction of the target whose direction is indicated by a target direction line referenced at 17 in FIGS. 3–5. In practice, the golfer selects a target and aligns golf training mat 1 such that the target and the golf ball are collinear with visual-aiming line 51 or a point between fore aiming line 6 and either of fore-auxiliary-aiming lines 8 (defined as extrapolation) with the golf ball lying approximately in ball-placement zone 13 or preferably at golf-ball-position locator 14. The right-handed golfer positions his or her body with respect to the golfball by positioning his or her left foot or sternum with respect to golf ball, using main-ball-positioning line 4 or distal-auxiliary-positioning lines 10 or an extrapolation of those lines. This golf ball positioning will depend on the club used, the shot shape desired and the golfer's physical parameters. The golfer then completes the stance along reference alignment edge 2 such that the golfer's feet and shoulder line as referenced at 26 are parallel to reference alignment edge 2. Finally, the golfer squares the golf club's face as referenced at 28 to the ball—target line. In other words, the golfer must position golf club face 28 at 90 degrees to the imaginary line connecting the target, the golf ball and a point located on visual-aiming line 51 or a point on fore aiming line 6 or either of fore-auxiliary-aiming lines 8 or an extrapolation as described above. The golfer thus properly aligns himself or herself for a straight shot at the target. It is noted that golfers often find the described alignment technique troublesome in that when properly aimed and aligned as described, the right-handed golfer typically believes he or she is actually aiming to the left of the target. However, the golfer is properly aimed and aligned.

U.S. Pat. No. 4,915,387 describes aiming lines in front of the golf ball. While useful, these forward lines do little to assist the golfer in actually striking a straight or shaped golf shot. Modem golf instruction teaches that the backswing is initiated with a slight movement of the weight of the upper body toward the foot farthest from the target, with a simultaneous rotation of the shoulders and arms along the line described by the feet and shoulder line as referenced at 26. This rotation and upper body shift away from the target causes the path of club head face 28 to travel along, and roughly square to, the imaginary line of the target, golf ball and point on visual aiming line 51 for a distance of about 4 to 8 inches depending on the length of the club. This sets the club path on a motion which sets the swing on a proper plane for a solidly struck, controlled shot.

Takeaway-ball-positioning line 11 is used as a positioning line for developing the club takeaway path as described above. This is accomplished by aiming and aligning as also described above, but with an imaginary golf ball positioned at the intersection of an imaginary line collinear with takeaway-ball-positioning line 11 and visual-aiming line 51 (instead of using main-ball-positioning line 4, distal-auxiliary-positioning lines 10 or an extrapolation as earlier described). The golfer then initiates a backswing as described, stopping it as it just crosses aiming-squaring edge 3. Club head face 28 should be parallel or very nearly parallel to aiming-squaring edge 3 and centered or very nearly centered upon whichever aiming line was used in the aiming procedure. The technique thus sets the proper initial club head path.

A further feature of golf training mat 1 is its ability to teach the proper squaring (90 degrees to the ball—target line) of club head face 28. This is simply accomplished with aiming-squaring edge 3. Again, with an imaginary golf ball, the golfer aims golf training mat 1 to the target using the target and fore aiming line 6 or fore auxiliary aiming lines 8. The golfer then aligns his or her shoulder and feet parallel to reference-alignment edge 2, adopting a stance such that club head face 28 is lying on, or very near to, aiming-squaring edge 3. When the club, gripped by a golfer in a hitting position, is parallel to aiming-squaring edge 3, club head face 28 is truly and properly squared to the ball—target line. Rear main aiming line 7 and rear auxiliary aiming lines 9 assist in the earlier described aiming procedure in that these lines provide further visual assistance in developing the proper takeaway as described and can be used in developing the proper takeaway with a squared club head face 28 as described.

It will thus be seen that golf training mat 1 is a golf aiming and alignment training aid designed to teach golfers of all abilities the views and angles of proper aiming and alignment, and, through repetition, commit those views and angles to memory. Additionally, the present invention has features which assist the properly aligned golfer to initiate a backswing which keeps the golf club head on a path which promotes solid ball striking. Further, the present invention is designed to allow the golfer to practice squaring the golf club to the target and to develop the proper initial club takeaway path as prescribed by golf's most successful instructors. Further still, the present invention has positioning features which allow the golfer to position the ball relative to his or her forward foot or sternum in order to learn the best positioning given his or her swing shape, club used, and shot shape desired.

The present invention is further designed to have several highly favorable characteristics in addition to the described educational characteristics. In this regard, the present invention eliminates the need for a fixed ball position and is designed for easy portability, stow-ability in the golfer's bag and may easily be utilized on driving range mats or grass. Further, the present invention may readily be utilized on the actual golf course during practice rounds and may readily be utilized by either right or left-handed golfers. The present invention may be built in different sizes specific for a golfer's size and practice focus. Further, the present invention provides easy attractive display means and minimizes inventory space requirements and manufacturing costs.

Alternative Embodiment

Figure 6A:
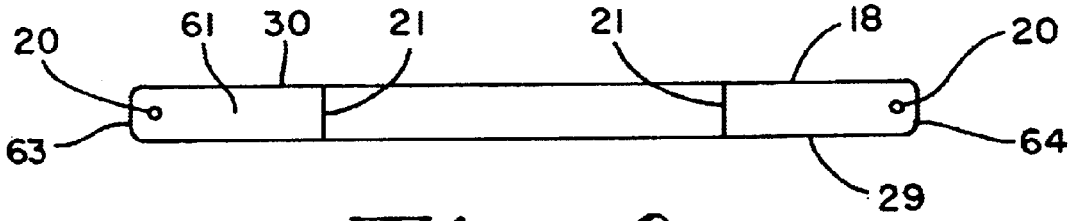
FIG. 6(*a*) is a top plan view of an auxiliary alignment blade attachment usable in combination with the alternative embodiment of the golf training apparatus.
Figure 6B:
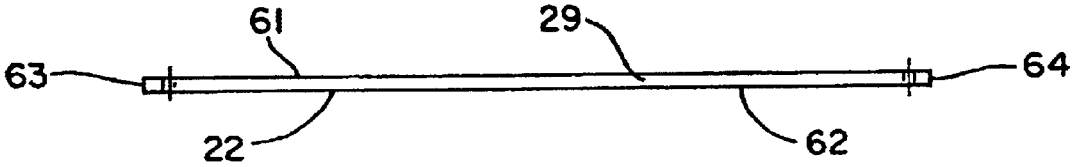

The alternative embodiment of the present invention is also designed for enabling a golfer to improve upon the golfer's aiming and alignment skills and in this regard enables a golfer to align and aim for variably controlled golf ball flight trajectories as will be discussed in more detail. The alternative embodiment of the present invention is virtually identical to the preferred embodiment of the present invention save for an auxiliary alignment blade assembly. The auxiliary alignment blade assembly comprises an auxiliary alignment blade 18, which may be removably attached to golf training mat 1 as illustrated in FIG. 5. Auxiliary alignment blade 18 is further illustrated in FIGS. 6(*a*), 6(*b*), 9 and 10. Auxiliary alignment blade 18 essentially comprises a centered longitudinal blade axis 60 as illustrated in FIG. 6(*a*); a superior blade surface 61 as illustrated in FIGS. 6(*a*), 6(*b*) and 9; an inferior blade surface 62 as referenced in FIGS. 6(*b*) and 9; a fore blade end 63 as illustrated in FIGS. 5, 6(*a*) and 6(*b*); a rear blade end 64 as illustrated in FIGS. 6(*a*) and 6(*b*); a linear distal blade edge 30 as illustrated in FIGS. 5, and 6(*a*); a linear proximal blade edge 29 as illustrated in FIGS. 5, 6(*a*) an 6(*b*); and a plurality of blade apertures 20 as illustrated in FIGS. 5 and 6(*a*). Preferably, at least one blade aperture 20 is adjacent fore blade end 63, thus providing a fore blade aperture and at least one blade aperture 20 is adjacent rear blade end 64 thus providing a rear blade aperture. Superior blade surface 61 preferably comprises reference markings 21 as illustrated in FIGS. 5 and 6(*a*). Reference markings 21 are preferably further defined by comprising a fore blade line and a rear blade line, the fore blade line orthogonally intersecting distal blade edge 30 and proximal blade edge 29 medial to the fore blade aperture and the fore blade end as illustrated. The rear blade line orthogonally intersects distal blade edge 30 and proximal blade edge 29 medial to the rear blade aperture and the rear blade end as further illustrated.

Figure 8:
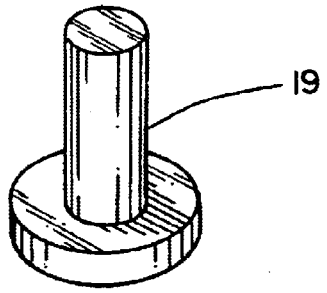
FIG. 8 is a perspective view of a pivot pin, which pivot pin functions to removably attach the auxiliary alignment blade to the mat.

The auxiliary alignment blade assembly further comprises pivot fastening means, which are cooperatively associated with auxiliary alignment blade 18 for removably attaching auxiliary alignment blade 18 to golf training mat 1 adjacent reference-alignment edge 2. The pivot fastening means may be further defined by preferably comprising a pivot pin 19 as illustrated in FIGS. 8 and 9. The pivot fastening means in general or pivot pin 19 in particular cooperatively associate with one of the proximally-located weighting eyelets 15. In this regard, pivot pin 19 is removably insertable through the selected proximally-located weighting eyelet 15 for removably attaching auxiliary alignment blade 18 to golf training mat 1. In this regard, pivot pin 19 may be inserted through a select blade aperture 20 from inferior blade surface 62 to superior blade surface 61 as is generally illustrated in FIG. 9. Pivot pin 19 may then be removably inserted through the selected proximally-located weighting eyelet 15 from inferior mat surface 41 to superior mat surface 40 as is further generally illustrated in FIG. 9.

Auxiliary alignment blade 18 is removably attached to golf training mat 1 and is thus pivotable about a blade pivot axis, which blade pivot axis is coaxial with a central eyelet axis orthogonal to the plane of golf training mat 1. It will thus be seen from an inspection of FIG. 9 that superior blade surface 61 is spatially located to pivot about the blade pivot axis in inferior adjacency to inferior mat surface 41. As will be seen from an inspection of FIG. 6(*a*) the blade ends, blade apertures 20, and blade lines or reference markings 21 are equidistant from centered longitudinal blade axis 60. In other words, auxiliary alignment blade 18 is symmetric about a center line and thus one lateral half of auxiliary alignment blade 18 is a mirrored image of the opposite lateral half. Further, it is contemplated that inferior blade surface 62 comprises a mirrored image of superior blade surface 61. These features enable the user to utilize auxiliary blade member 18 without needlessly exerting effort on choosing the correct spatial configuration of auxiliary alignment blade. The user may simply removably attach auxiliary alignment blade 18 in the described manner without regard to choosing the correct blade end to attach and without regard to choosing the correct surface to display.

The ability to shape shots as earlier described distinguishes the highly skilled golfer from other less-skilled golfers. However, average golfers have the same need to create shaped shots as a means of bending shots around obstacles, countering wind effects, and safely approaching pins placed near the edges of greens. Golfers learning shot shaping skills usually learn the basics from professional instructors. However, shaping shots reliably requires practice. Auxiliary alignment blade 18 allows the golfer to practice shot shaping using sound modem techniques.

FIG. 3 shows the present invention as configured to strike a shot shaped to travel to the target with a left-to-right trajectory, which left-to-right trajectory for a right-handed golfer is defined as a "fade." Conversely, for a right-handed golfer, a shot shaped to travel to the target in a right-to-left trajectory is defined as a "draw." It should be noted that a right-handed golfer's "draw" is a left-handed golfer's "fade" and a right-handed golfer's "fade" is a left-handed golfer's "draw." For a right-handed "fade" shot, pivot pin 19 is inserted through the blade aperture 20 adjacent the rear blade end and the proximal weighting eyelet 15 furthest from the target. For a right-handed "draw" shot, the set-up procedure is the same except that pivot pin 19 is inserted through the blade aperture 20 adjacent the fore blade end and the proximal weighting eyelet 15 closest to the target.

The operation to strike a "fade" may be described as follows. The golfer pivots the fore blade end toward the golfer to create an angle between proximal blade edge 29 and reference-alignment edge 2 of the order to between 2 and 10 degrees. A nominal and repeatable angle is created by aligning a first small-angle point (defined by the structural junction of the fore blade end and distal blade edge 30) with reference-alignment edge 2. Another, repeatable alignment point is enabled by aligning a first large-angle point (defined by the intersection of the left blade line with distal blade edge 30) with reference-alignment edge 2. The result of pivoting auxiliary alignment blade 18 into the described positions is to create an angled-reference edge referenced at 29 in FIG. 5, which angled-reference edge 29 is at an angle to reference-alignment edge 2. The golfer aligns his or her feet and shoulder line as referenced by 26 parallel to angled-reference edge 29, positions the golf ball as earlier described, and importantly, squares club head face 28 to the ball—target line as earlier described. The angle between club head face 28 and the golfer's feet and shoulder line as referenced at 26 is now greater than 90 degrees, thus making his or her alignment "open."

The right-handed golfer creates the left-to-right ("fade") trajectory by initiating the swing as earlier described so that on the downswing, at impact, club head face 28 strikes the golf ball at a slight glancing angle, roughly the same as the angle between reference-alignment edge 2 and angled-reference edge 29, thus imparting a slight clockwise spin to the golf ball, while projecting the ball in an initial direction to the left of the target. The clockwise spin will cause the trajectory to bend left-to-right to the target.

In order to strike a ball with a right-to-left trajectory ("draw"), auxiliary alignment blade 18 is set up as earlier described. Auxiliary alignment blade 18 is then pivoted to a small or large angled position. In this regard, a nominal and repeatable angle is created by aligning a second small-angle point (defined by the structural junction of the rear blade end and distal blade edge 30) with reference-alignment edge 2. Another, repeatable alignment point is enabled by aligning a second large-angle point (defined by the intersection of the right blade line with distal blade edge 30) with reference-alignment edge 2. Again the golfer squares club head face 28 and aligns his or her body parallel to angled-reference edge 29. The angle between club head face 28 and the golfer's feet and shoulder line as referenced at 26 is now less than 90 degrees and the golfer adopts a "closed" stance. The golfer initiates his or her swing along his or her feet and shoulder line such that on the downswing, at impact, club head face 28 strikes the golf ball at a slight glancing angle, again roughly the same angle as between reference-alignment edge 2 and angled-reference edge 29. This technique imparts a slight counterclockwise spin to the golf ball, while projecting the ball in an initial direction to the right of the target. The counterclockwise spin will cause the trajectory to bend right-to-left to the target.

Figure 10:
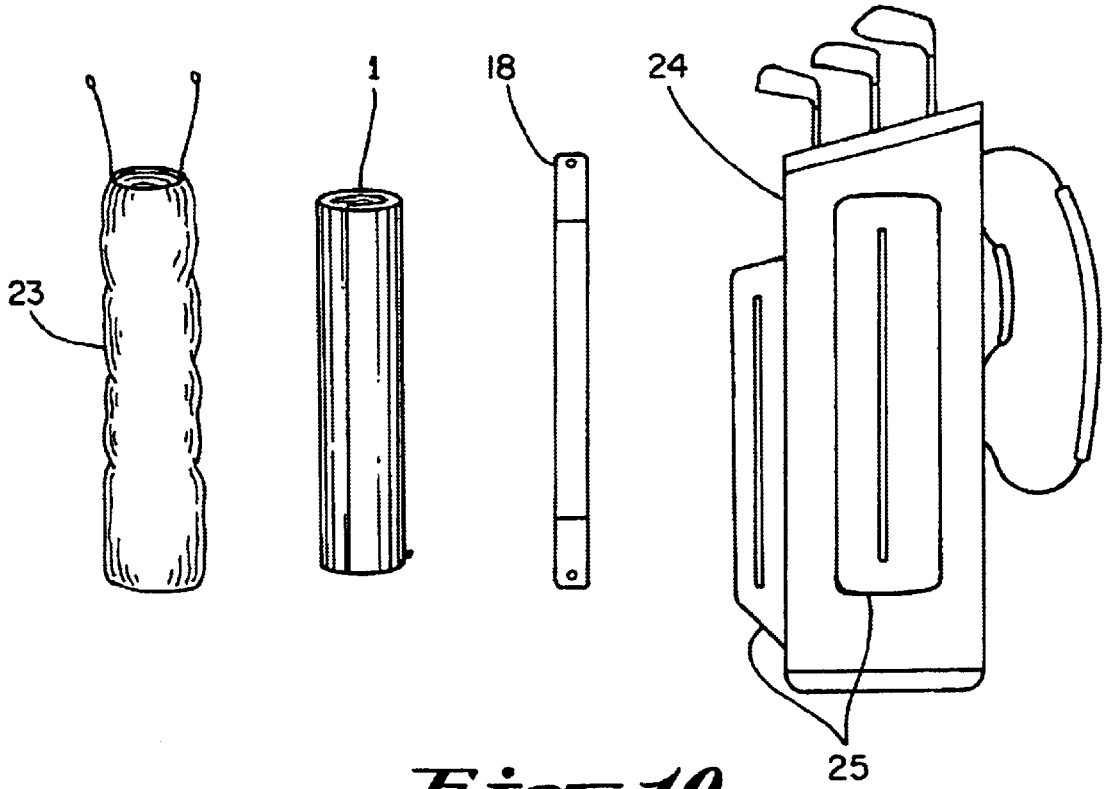
FIG. 10 is a side view of an apparatus-containing bag for containing a rolled golf training apparatus, a rolled mat, an auxiliary alignment blade and a golf bag for containing the apparatus-containing bag.

With specific reference to FIG. 10, and as earlier noted, it will be understood that golf training mat 1 is designed to have favorable portability and stowability features. The high compliance and low memory characteristics of golf training mat 1 allow it to be rolled and carried, or rolled and secured with a simple strap, or rolled and stowed in a bag as referenced at 23. Golf training mat 1, bag 23 and auxiliary alignment blade 18 are illustrated in FIG. 10 in rough relative size to a golfbag 24 with pouches 25. All items, including pivot pin 19, can be stowed and carried in golf bag 24 or in pouches 25. Alternatively, golf training mat 1, auxiliary alignment blade 18 and pivot pin 19 can also be stowed in bag 23 and carried separately.

It will be seen that the present invention further provides a golf training mat that teaches the golfing user proper aiming and feet/shoulder/golf club alignment methods by teaching and reinforcing the correct views and angles. It will be further seen that the present invention provides a golf training mat, unique in its combination of educational utility and soundness. Further, it will be seen that the present invention provides a golf training mat which is easy of use, easy to stow and easy to transport. Still further, it will be seen that the present invention provides a golf training mat low in cost and which comprises attractive retail commercial features.

More particularly, it will be seen that the present invention provides an L-shaped golf training mat for enabling the golfer to improve upon the golfer's aiming and alignment skills wherein the L-shaped golf training mat is defined by comprising a substantially planar superior mat surface comprising main mat coloration for providing a visualization template upon which are placed unique positioning-aiming markings. Further, it will be seen that the present invention provides positioning-aiming markings uniquely positioned on the superior mat surface of an L-shaped mat, which markings are longitudinally and latitudinally aligned in particular spatial locations for enabling the golfer to visualize an effective ball-placement-zone distally removed from the L-shaped mat relative to the golfer and defined by distally extending and laterally extending zone lines collinear with the positioning-aiming markings. Further, it will be seen that the present invention provides positioning-aiming lines atop an L-shaped golf training mat, which enable the golfer to visualize a preferred golf-ball-position locator, and which golf-ball-position locator is the geometric center of the ball-placement zone defined by a distally-laterally removed orthogonal intersection of lines collinear with select position-aiming markings. It will thus be seen that present invention provides an L-shaped golf training mat comprising positioning-aiming markings, which enable a golfer to effectively visualize a golf ball position locator distally and laterally removed from portions of the L-shaped mat, which golf ball position locator functions in cooperative association with the positioning-aiming markings to enable the golfer to align and aim golf shots for more readily controllable golf ball flight trajectories.

Further, it will be seen that the present invention provides an upendable mat for selective use either by a right-handed golfer or a left-handed golfer. In this regard, it will be seen that the present invention provides a golf training mat comprising markings on the superior mat surface and markings on the inferior mat surface, which markings are mirror images of one another and are configured such that a right-handed golfer may upend or flip over the golf training mat from a right-handed configuration and expose the golf training mat's right-handed inferior mat surface to a left-handed superior mat surface for use by a left-handed golfer.

Still further, it will be seen that the present invention provides an auxiliary alignment blade removably attachable to the L-shaped golf training mat for enabling the golfer to align and aim golf shots for variably controlled golf ball flight trajectories. In this regard, it will be seen that the present invention provides an L-shaped training mat and auxiliary alignment blade combination, wherein the superior blade surface comprises reference markings which function in cooperative association with positioning-aiming markings on the superior mat surface to enable a golfer to align and aim for variably controlled golf ball flight trajectories.

While the above description contains much specificity, this specificity should not be construed as limitations on the scope of the invention, but rather as an exemplification of the invention. For example, it is contemplated that golf training mat need not comprise an L-shape. For example, a T-shaped mat essentially comprising two back-to-back integrally-formed L-shaped mats may function to achieve the aiming and alignment instruction as described herein and is believed to be within the spirit of the presenting invention. In other words, a T-shaped mat may function to achieve similar results provided two sets of aiming lines are positioned atop either the superior or inferior mat surface such that the distal portions of the mat are mirrored images of the proximal portions of the mat, thus making a substantially T-shaped mat for use by either a right-handed golfer or a left-handed golfer by rotating the mat about a central mat axis instead of flipping over the mat to expose a mirrored image inferior mat surface. In other words, a T-shaped mat would provide a mat in which a right handed golfer would stand in the left-handed ball placement zone during a golf swing and similarly, a left-handed golfer would stand in the right-handed ball placement zone when executing a left-handed golf swing.

Further, it is contemplated that the pivot fastening means need not comprise a pivot pin, but instead may comprise at least one pin-like member integrally molded with auxiliary alignment blade on the superior blade surface in place of the blade apertures 20. In this regard, a separate pin would not be required. A pivot pin, however, is preferable to achieve a more planar auxiliary alignment blade 18, thus increasing ease of use of the described golf training apparatus.

Accordingly, although the invention has been described by reference to a preferred embodiment, an alternative embodiment and a kit based on the preferred and alternative embodiments, it is not intended that the novel assemblies and kit be limited thereby, but that modifications thereof are intended to be included as falling within the broad scope and spirit of the foregoing disclosure, the following claims and the appended drawings.

I claim:

1. A golf training mat for enabling a golfer to improve upon the golfer's aiming and alignment skills, the golf training mat comprising a substantially planar, L-shaped mat, the L-shaped mat comprising a superior mat surface, an inferior mat surface, a longitudinal axis, a latitudinal axis, six peripheral edges, five interior corners, and one exterior corner, the superior mat surface comprising main mat coloration for providing a visualization template, the inferior mat surface for compliantly engaging an underlying substrate surface, the longitudinal axis and the latitudinal axis orthogonally intersecting at the exterior corner, the six peripheral edges comprising three latitudinal edges and three longitudinal edges, the latitudinal edges comprising a distal mat edge distally parallel to the latitudinal axis, a reference-positioning edge coaxial with the latitudinal axis, and a reference-alignment edge proximally parallel to the latitudinal axis, the longitudinal edges comprising a fore mat edge laterally spaced and parallel to the longitudinal axis, an aiming-squaring edge coaxial with the longitudinal axis, and a rear mat edge laterally spaced and parallel to the longitudinal axis, the superior surface comprising positioning-aiming markings, the positioning-aiming markings comprising longitudinal positioning lines and latitudinal aiming lines, the positioning lines comprising a main-ball-positioning pattern and a takeaway-ball-positioning line, the main-ball-positioning pattern comprising a main-ball-positioning line, paired distal-auxiliary-positioning lines, and paired proximal auxiliary-positioning lines, the main-ball-positioning line orthogonally intersecting the reference-positioning edge and the reference-alignment edge, the distal-auxiliary-positioning lines orthogonally intersecting the reference-positioning edge laterally opposite and equidistant from the main-ball-positioning line, the proximal-auxiliary-positioning lines orthogonally intersecting the reference-alignment edge laterally opposite and equidistant from the main-ball-positioning line, the distal-auxiliary-positioning lines being collinear with the proximal-auxiliary-positioning lines, the takeaway-ball-positioning line orthogonally intersecting the reference-positioning edge and the reference alignment edge medial to the main-ball-positioning pattern, the main-ball-positioning line for enabling the golfer to visualize a visual-positioning-line extending distally from the reference-positioning edge collinear with the main-ball-positioning line, the aiming lines comprising a fore-main-aiming line, a rear-main-aiming line, paired fore-auxiliary-aiming lines, and paired rear-auxiliary-aiming lines, the fore-main-aiming line orthogonally intersecting the aiming-squaring edge, the fore-auxiliary-aiming lines orthogonally intersecting the aiming-squaring edge longitudinally opposite and equidistant from the fore-main-aiming line, the rear-main-aiming line orthogonally intersecting the rear mat edge, the rear-auxiliary-aiming lines orthogonally intersecting the rear mat edge longitudinally opposite and equidistant from the rear-main-aiming line, the fore-auxiliary-aiming lines being collinear with the rear-auxiliary-aiming lines, the fore-main-aiming line being collinear with the rear-main-aiming line thus forming a collinear main-aiming-line-pairing, the main-aiming-line pairing for enabling the golfer to visualize a visual-aiming line extending laterally from the aiming-squaring edge collinear with the main-aiming-line-pairing, the main-ball-positioning pattern and the aiming lines for enabling a golfer to visualize an effective ball-placement zone, the ball-placement zone being defined by zone lines collinear with the main-ball-positioning pattern and the aiming lines, the ball-placement zone comprising a preferred golf-ball-position locator, the golf-ball-position locator being defined by an orthogonal intersection of the visual-positioning line and the visual-aiming line, the positioning-aiming markings thus enabling a golfer to align and aim for controlled golf ball flight trajectories.

2. The golf training mat of claim 1 wherein the L-shaped mat comprises a compliant, low memory material.

3. The golf training mat of claim 2 wherein the internal corners each comprise a weighting eyelet.

4. The golf training mat of claim 3 wherein the positioning-aiming markings comprise line coloration, the line coloration contrasting with the main mat coloration.

5. The golf training mat of claim 4 wherein the reference-positioning edge, reference-alignment edge, and the aiming-squaring edge comprise edge coloration, the edge coloration contrasting with the main mat coloration.

6. The golf training mat of claim 1 wherein the inferior mat surface comprises a mirrored image of the superior surface.

7. A golf training apparatus for enabling a golfer to improve upon the golfer's aiming and alignment skills, the golf training mat apparatus comprising in combination:

a substantially planar, L-shaped mat, the L-shaped mat comprising a superior mat surface, an inferior mat surface, a longitudinal axis, a latitudinal axis, six peripheral edges, five interior corners, and one exterior corner, the superior mat surface comprising main mat coloration for providing a visualization template, the inferior mat surface for compliantly engaging an underlying substrate surface, the longitudinal axis and the latitudinal axis orthogonally intersecting at the exterior corner, the five interior corners comprising three distal corners and two proximal corners, the proximal corners each comprising a proximal weighting eyelet, the proximal weighting eyelets each comprising a central eyelet axis extending through its center orthogonal to the plane of the L-shaped mat, the six peripheral edges comprising three latitudinal edges and three longitudinal edges, the latitudinal edges comprising a distal mat edge distally parallel to the latitudinal axis, a reference-positioning edge coaxial with the latitudinal axis, and a reference-alignment edge proximally parallel to the latitudinal axis, the longitudinal edges comprising a fore mat edge laterally spaced and parallel to the longitudinal axis, an aiming-squaring edge coaxial with the longitudinal axis, and a rear mat edge laterally spaced and parallel to the longitudinal axis, the superior surface comprising positioning-aiming markings, the positioning-aiming markings comprising longitudinal positioning lines and latitudinal aiming lines, the positioning lines comprising a main-ball-positioning pattern and a takeaway-ball-positioning line, the main-ball-positioning pattern comprising a main-ball-positioning line, paired distal-auxiliary-positioning lines, and paired proximal-auxiliary-positioning lines, the main-ball-positioning line orthogonally intersecting the reference-positioning edge and the reference-alignment edge, the distal-auxiliary-positioning lines orthogonally intersecting the reference-positioning edge laterally opposite and equidistant from the main-ball-positioning line, the proximal-auxiliary-positioning lines orthogonally intersecting the reference-alignment edge laterally opposite and equidistant from the main ball positioning line, the distal-auxiliary-positioning lines being collinear with the proximal-auxiliary-positioning lines, the takeaway-ball-positioning line orthogonally intersecting the reference-positioning edge and the reference alignment edge medial to the main ball positioning pattern, the main-ball-positioning line for enabling the golfer to visualize a visual-positioning-line extending distally from the reference-positioning edge collinear with the main-ball-positioning line, the aiming lines comprising a fore-main-aiming line, a rear-main-aiming line, paired fore-auxiliary-aiming lines, and paired rear auxiliary aiming lines, the fore-main-aiming line orthogonally intersecting the aiming-squaring edge, the fore-auxiliary-aiming lines orthogonally intersecting the aiming-squaring edge longitudinally opposite and equidistant from the fore-main-aiming line, the rear-main-aiming line orthogonally intersecting the rear mat edge, the rear-auxiliary-aiming lines orthogonally intersecting the rear mat edge longitudinally opposite and equidistant from the rear-main-aiming line, the fore-auxiliary-aiming lines being collinear with the rear-auxiliary-aiming lines, the fore-main-aiming line being collinear with the rear-main-aiming line thus forming a collinear main-aiming-line-pairing, the main-aiming-line pairing for enabling a golfer to visualize a visual-aiming line extending laterally from the aiming-squaring edge collinear with the main-aiming-line-pairing, the main-ball-positioning pattern and the aiming lines enabling a golfer to visualize an effective ball-placement-zone, the ball-placement-zone being defined by a zone lines collinear with the main-ball-positioning pattern and the aiming lines, the ball-placement-zone comprising a preferred golf-ball-position locator, the golf-ball-position locator being defined by an orthogonal intersection of the visual-positioning line and the visual-aiming line, the positioning-aiming markings thus enabling a golfer to align and aim for controlled golf ball flight trajectories;

an auxiliary alignment blade, the auxiliary alignment blade comprising a centered longitudinal blade axis, a superior blade surface, an inferior blade surface, a fore blade end, a rear blade end, a distal blade edge, and a proximal blade edge; and pivot fastening means cooperatively associated with the auxiliary alignment blade for removably attaching the auxiliary alignment blade to the L-shaped mat adjacent the reference-alignment edge, the pivot fastening means being cooperatively associated with one of the proximal weighting eyelets, the removably attached auxiliary alignment blade being pivotable about a blade pivot axis coaxial with the central eyelet axis of the selected proximal weighting eyelet for enabling a golfer to align and aim for variably controlled golf ball flight trajectories.

8. The golf training apparatus of claim 7 wherein the L-shaped mat comprises a compliant, low memory material.

9. The golf training apparatus of claim 8 wherein the distal corners each comprise distal weighting eyelets.

10. The golf training apparatus of claim 8 wherein the inferior mat surface comprises a mirrored image of the superior surface.

11. The golf training apparatus of claim 10 wherein the auxiliary alignment blade comprises a plurality of blade apertures, at least one blade aperture being adjacent the fore blade end and at least one blade aperture being adjacent the rear blade end.

12. The golf training apparatus of claim 11 wherein the pivot fastening means is defined by a pin selectively insertable through one of the blade apertures and one of the proximal weighting eyelets.

13. The golf training apparatus of claim 12 wherein the superior blade surface comprises reference markings.

14. The golf training apparatus of claim 13 wherein the reference markings comprise a fore blade line and a rear blade line, the fore blade line orthogonally intersecting the distal blade edge and the proximal blade edge medial to the blade aperture adjacent the fore blade end, the rear blade line orthogonally intersecting the distal blade edge and the proximal blade edge medial to the blade aperture adjacent the rear blade end.

15. The golf training apparatus of claim 14 wherein the blade ends, the blade apertures, and the blade lines are equidistant from the centered longitudinal blade axis.

16. The golf training apparatus of claim 7 wherein the superior blade surface is spatially located to pivot about the blade pivot axis in inferior adjacency to the inferior mat surface.

17. The golf training apparatus of claim 7 wherein the inferior blade surface comprises a mirrored image of the superior blade surface.

18. A golf training apparatus for enabling a golfer to improve upon the golfer's aiming and alignment skills, the golf training apparatus comprising a substantially planar mat, the mat comprising a superior mat surface, an inferior mat surface, a longitudinal axis, a latitudinal axis, a plurality of latitudinal edges, a plurality of longitudinal edges, and at least one exterior corner, the longitudinal axis and the latitudinal axis intersecting at the exterior corner, the superior mat surface comprising main mat coloration, the latitudinal edges comprising at least one distal mat edge distally parallel to the latitudinal axis, at least one reference-positioning edge coaxial with the latitudinal axis, and at least one reference-alignment edge proximally parallel to the latitudinal axis, the longitudinal edges comprising a fore mat edge lateral to the longitudinal axis, at least one aiming-squaring edge coaxial with the longitudinal axis, and a rear mat edge lateral to the longitudinal axis opposite the fore mat edge, the superior mat surface comprising positioning-aiming markings, the positioning-aiming markings comprising at least one longitudinal positioning line and at least one latitudinal aiming line, the positioning line being parallel to the aiming-squaring edge intermediate the reference-positioning edge and the reference-alignment edge, the positioning line for enabling a golfer to visualize a first locating line extending distally from the reference-positioning edge collinear with the positioning line, the aiming line being parallel to the reference-positioning edge intermediate the aiming-squaring edge and the rear mat edge, the aiming line for enabling a golfer to visualize a second locating line extending laterally from the aiming-squaring edge collinear with the aiming line, the positioning line and the aiming line thus enabling a golfer to visualize an effective ball-placement locator, the ball-placement locator being defined by an intersection of the first locating line and the second locating line, the positioning-aiming markings thus enabling a golfer to align and aim for controlled golf ball flight trajectories.

19. The golf training apparatus of claim 18 wherein the mat comprises a compliant, low memory material.

20. The golf training apparatus of claim 18 wherein the inferior mat surface comprises a mirrored image of the superior mat surface.

21. The golf training apparatus of claim 18 wherein the mat comprises a plurality of internal corners, the internal corners each comprising a weighting eyelet.

22. The golf training apparatus of claim 18 wherein the mat is L-shaped.

23. The golf training apparatus of claim 18 wherein the positioning-aiming markings comprise a takeaway-ball-positioning line medially parallel to the positioning line.

24. The golf training apparatus of claim 23 wherein the positioning-aiming markings comprise line coloration, the line coloration contrasting with the main mat coloration.

25. The golf training apparatus of claim 24 wherein the reference-positioning edge, reference-alignment edge, and the aiming-squaring edge comprise edge coloration, the edge coloration contrasting with the main mat coloration.

26. The golf training apparatus of claim 23 wherein the positioning-aiming markings comprise paired distal-auxiliary-positioning lines, paired proximal auxiliary-positioning lines, paired fore-auxiliary-aiming lines, and paired rear-auxiliary-aiming lines, the distal-auxiliary-positioning lines and the proximal auxiliary-positioning lines being laterally opposite and equidistant from the positioning line, the fore-auxiliary-aiming lines and the rear-auxiliary-aiming lines being longitudinally opposite and equidistant from the aiming line, the distal-auxiliary-positioning lines being collinear with the proximal-auxiliary-positioning lines, the fore-auxiliary-aiming lines being collinear with the rear-auxiliary-aiming lines, the positioning-aiming markings for enabling a golfer to visualize an effective ball-placement zone, the ball-placement locator being at the geometric center of the ball-placement zone.

27. The golf training apparatus of claim 18 wherein the golf training apparatus comprises an auxiliary alignment blade assembly, the auxiliary alignment blade assembly comprising an auxiliary alignment blade and pivot fastening means, the pivot fastening means being cooperatively associated with the auxiliary alignment blade for removably attaching the auxiliary alignment blade to a select, proximally-located weighting eyelet, the removably attached auxiliary alignment blade being pivotable about a blade pivot axis orthogonal to the plane of the mat for enabling a golfer to align and aim for variably controlled golf ball flight trajectories.

28. An upendable golf training apparatus for enabling either a right-handed or a left-handed golfer to improve upon the golfer's aiming and alignment skills, the golf training apparatus comprising:

a substantially planar mat, the mat comprising a superior mat surface and an inferior mat surface, and a plurality of internal corners, the superior mat surface and the inferior mat surface each comprising positioning-aiming markings, the positioning-aiming markings comprising longitudinally-aligned positioning markings and latitudinally-aligned aiming markings, the inferior mat surface being a mirrored image of the superior mat surface for enabling either a right-handed or a left-handed golfer to improve upon the golfer's aiming and alignment skills, the positioning markings and the aiming markings for enabling a golfer to visualize an effective ball-placement locator distally removed from the mat, the ball-placement locator for enabling a golfer to align and aim for controlled golf ball flight trajectories; and an auxiliary alignment blade assembly, the auxiliary alignment blade assembly comprising an auxiliary alignment blade and pivot fastening means cooperatively associated with the auxiliary alignment blade, the auxiliary alignment blade comprising a superior blade surface and an inferior blade surface, the pivot fastening means for removably attaching the auxiliary alignment blade adjacent one of the internal corners, the removably attached auxiliary alignment blade being pivotable about a blade pivot axis for enabling a golfer to align and aim for variably controlled golf ball flight trajectories.

29. The upendable golf training apparatus of claim 28 wherein the mat comprises a compliant, low memory material.

30. The upendable golf training apparatus of claim 28 wherein the mat is L-shaped.

31. The upendable golf training apparatus of claim 28 wherein the superior blade surface comprises reference markings.

32. The upendable golf training apparatus of claim 31 wherein the inferior blade surface comprises a mirrored image of the superior blade surface.

33. The upendable golf training apparatus of claim 28 wherein the superior blade surface is spatially located to pivot about the blade pivot axis in inferior adjacency to the inferior mat surface.

34. An upendable golf training apparatus for enabling either a right-handed or a left-handed golfer to improve upon the golfer's aiming and alignment skills, the golf training apparatus comprising a substantially planar mat, the mat comprising a superior mat surface, an inferior mat surface, a plurality of internal corners, an auxiliary alignment blade, and pivot fastening means, the superior mat surface and the inferior mat surface each comprising positioning-aiming markings, the positioning-aiming markings comprising longitudinally-aligned positioning markings and latitudinally-aligned aiming markings, the inferior mat surface being a mirrored image of the superior mat surface for enabling either a right-handed or a left-handed golfer to improve upon the golfer's aiming and alignment skills, the positioning markings and the aiming markings for enabling a golfer to visualize an effective ball-placement locator distally removed from the mat, the ball-placement locator for enabling a golfer to align and aim for controlled golf ball flight trajectories, the pivot fastening means being cooperatively associated with the auxiliary alignment blade for removably attaching the auxiliary alignment blade to one of the internal corners, the removably attached auxiliary alignment blade being pivotable about a blade pivot axis orthogonal to the plane of the mat for enabling a golfer to align and aim for variably controlled golf ball flight trajectories.

* * * * *